US010335938B2

(12) United States Patent
Hsieh

(10) Patent No.: US 10,335,938 B2
(45) Date of Patent: Jul. 2, 2019

(54) CUSHION DEVICE FOR CYLINDER OF PNEUMATIC TOOL

(71) Applicant: Chih Kuan Hsieh, Hemei Township (TW)

(72) Inventor: Chih Kuan Hsieh, Hemei Township (TW)

( * ) Notice: Subject to any disclaimer, the term of this patent is extended or adjusted under 35 U.S.C. 154(b) by 365 days.

(21) Appl. No.: 15/390,838

(22) Filed: Dec. 27, 2016

(65) Prior Publication Data

US 2017/0106519 A1 Apr. 20, 2017

Related U.S. Application Data

(63) Continuation-in-part of application No. 14/666,774, filed on Mar. 24, 2015, now Pat. No. 9,844,867.

(51) Int. Cl.

| | |
|---|---|
| ***B25D 17/24*** | (2006.01) |
| ***B25D 9/04*** | (2006.01) |
| ***B25D 9/08*** | (2006.01) |

(52) U.S. Cl.

CPC ..... *B25D 17/24* (2013.01); *B25D 9/04* (2013.01); *B25D 9/08* (2013.01); *B25D 17/245* (2013.01); *B25D 2217/0073* (2013.01); *B25D 2250/275* (2013.01)

(58) Field of Classification Search

CPC ..... B25D 17/24; B25D 9/08; B25D 17/245; B25D 2250/275

USPC ..... 173/17, 117, 137, 139, 162.1; 227/9, 10, 227/130

See application file for complete search history.

(56) References Cited

U.S. PATENT DOCUMENTS

| | | | | |
|---|---|---|---|---|
| 4,388,972 A * | 6/1983 | Gidlund | B25D 17/245 173/162.1 |
| 4,776,408 A * | 10/1988 | Elkin | B25D 17/24 173/162.1 |
| 8,340,394 B2 * | 12/2012 | Socha | G03F 7/70283 382/145 |
| 9,844,867 B2 * | 12/2017 | Hsieh | B25D 17/24 |

* cited by examiner

*Primary Examiner* — Nathaniel C Chukwurah
(74) *Attorney, Agent, or Firm* — Alan D. Kamrath; Mayer & Williams PC

(57) ABSTRACT

A cushion device is used for a cylinder of a pneumatic tool, and the pneumatic tool contains: a body, a cylinder, a valve unit, a piston member, a cushion washer, and at least one spring. The body includes a grip and a fitting sleeve having a chamber, a closing element, and an opening. The cylinder is fitted in the chamber and includes a room and an abutting portion. The valve unit is mounted between the room and the abutting portion. The piston member is accommodated in the room and slides along a movement axis. The cushion washer and the at least one spring are mounted in the chamber, and the cushion washer abuts against the closing element and the pressing face. The cushion washer includes at least one open segment which has at least one air groove each having a mouth parallel to the movement axis.

8 Claims, 9 Drawing Sheets

CUSHION DEVICE FOR CYLINDER OF PNEUMATIC TOOL

This application is a continuation application claiming priority under 35 U.S.C. § 120 to U.S. patent application Ser. No. 14/666,774, entitled CUSHION DEVICE FOR CYLINDER OF PNEUMATIC TOOL, filed Mar. 24, 2015, which issued on Dec. 19, 2017 as U.S. Pat. No. 9,844,867.

BACKGROUND OF THE INVENTION

Field of the Invention

The present invention relates to a cushion device, and more particularly to a cushion device for a cylinder of a pneumatic tool which reduces vibration.

Description of the Prior Art

A conventional pneumatic tool is driven by a high pressure air used as a power source. With reference to FIG. 9, the conventional pneumatic tool contains: a grip 10, a valve unit 20, a cylinder 30, and a piston member 40. The grip 10 includes an air inlet segment 101 connected with a high pressure air, an air passage 102 communicating with the air inlet segment 101, a control switch (not shown) for controlling the high pressure air to flow into the air inlet segment 101, and a cylindrical portion 103. The cylindrical portion 103 has a chamber 104 defined therein and communicating with the air passage 102. The valve unit 20 is mounted in the chamber 104 of the cylindrical portion 103, and one end of the cylinder 30 is inserted into the chamber 104 of the cylindrical portion 103, such that the cylinder 30 contacts with the valve unit 20. The cylinder 30 includes a room 301 defined therein and a flowing channel 302 formed between a front end of the room 301 and the valve unit 20, wherein the flowing channel 302 is in communication with the front end of the room 301 and the valve unit 20, and the piston member 40 is accommodated and slides in the room 301 of the cylinder 30. As turning on the control switch on the grip 10, the high pressure air flows into the valve unit 20 in the chamber 104 of the cylindrical portion 103 from the air inlet segment 101 of the grip 10 via the air passage 102, and the valve unit 20 controls the high pressure air to flow into the room 301 of the cylinder 30 and to push the piston member 40 toward a predetermined position, such that a tool head (not shown) is hit by the piston member 40, and the tool head stops the piston member 40, thereafter the valve unit 20 controls the high pressure air to flow into a front end of the room 301 of the cylinder 30 through the flowing channel 302, such that the piston member 40 is pushed by the high pressure air to slide backward to impact the valve unit 20, hence the piston member 40 is stopped by the valve unit 20, thus moving the piston member 40 to operate the pneumatic tool.

However, when the piston member 40 slides backward to impact the valve unit 20, a reaction force produces and passes toward user's hand, thus gripping the pneumatic tool difficultly and hurting the user's waist easily.

To overcome above-mentioned problem, a cylindrical cushion washer or a spring is fixed in the chamber of the cylindrical portion, such that the cylindrical cushion washer or the spring cushions impact force and absorbs vibration, when the piston member 40 slides backward to impact the valve unit 20, thereby absorbing vibration and decreasing reaction force which passes toward the user's hand. Nevertheless, the cylindrical cushion washer and the spring cannot cushion the impact force evenly to reduce the reaction force. In addition, the cylindrical cushion washer and the spring cause elastic fatigue in repeated use, thus increasing use cost.

The present invention has arisen to mitigate and/or obviate the afore-described disadvantages.

SUMMARY OF THE INVENTION

The primary objective of the present invention is to provide a cushion device for a cylinder of a pneumatic tool in which a cushion washer and at least one spring are mounted in a chamber of a fitting sleeve of a body, and the cushion washer abuts against a closing element of the chamber of the fitting sleeve and a pressing face of an abutting portion of a cylinder, wherein the cushion washer includes at least one open segment arranged on at least one end thereof, the open segment has at least one air groove, and the at least one spring is pressed by the cushion washer to distort, such that when the piston member moves backward to impact the valve unit, the cushion washer mates with the at least one spring to provide elasticity, and the at least one air groove produces two-section shock absorption and reduces a reaction force of the cylinder which passes toward a user's hand.

Another objective of the present invention is to provide a cushion device for a cylinder of a pneumatic tool in which the cushion washer includes the at least one open segment arranged on the at least one end thereof, and the open segment has the at least one air groove, hence the cushion washer mates with the at least one spring and does not cause elastic fatigue in repeated use, thus reducing use cost.

To obtain above-mentioned objectives a cushion device for a cylinder of a pneumatic tool provided by the present invention contains: a body, a cylinder, a valve unit, a piston member, a cushion washer, and at least one spring.

The body includes a grip and a fitting sleeve fitted with the grip, the fitting sleeve has a chamber defined therein, a closing element formed on a first end thereof, and an opening formed on a second end thereof. The closing element has an accommodation trough defined on a first side thereof facing the opening.

The cylinder is slidably fitted in the chamber of the fitting sleeve, and a part of the cylinder extends out of the fitting sleeve from the opening of the chamber. The cylinder includes a room formed therein and an abutting portion adjacent to the closing element of the chamber of the fitting sleeve.

The valve unit is mounted between the room and the abutting portion of the cylinder.

The piston member is accommodated in the room of the cylinder and sliding forward and backward along a movement axis.

The cushion washer is flexible and is mounted in the chamber of the fitting sleeve, and the cushion washer abuts against the closing element of the chamber of the fitting sleeve and the pressing face of the abutting portion of the cylinder. The cushion washer includes at least one open segment arranged on at least one end thereof corresponding to the closing element, the at least one open segment has the at least one air groove, and each of the at least one air groove has a mouth parallel to the movement axis of the piston member. The cushion washer also includes a raised close segment formed on a second end thereof and corresponding to the pressing face.

The at least one spring is fixed in the chamber of the fitting sleeve and is housed in the accommodation trough of the closing element, wherein the at least one spring is pressed by the cushion washer to distort.

DETAILED DESCRIPTION OF THE PREFERRED EMBODIMENTS

The present invention will be clearer from the following description when viewed together with the accompanying drawings, which show, for purpose of illustrations only, a preferred embodiment in accordance with the present invention.

Figure 1:
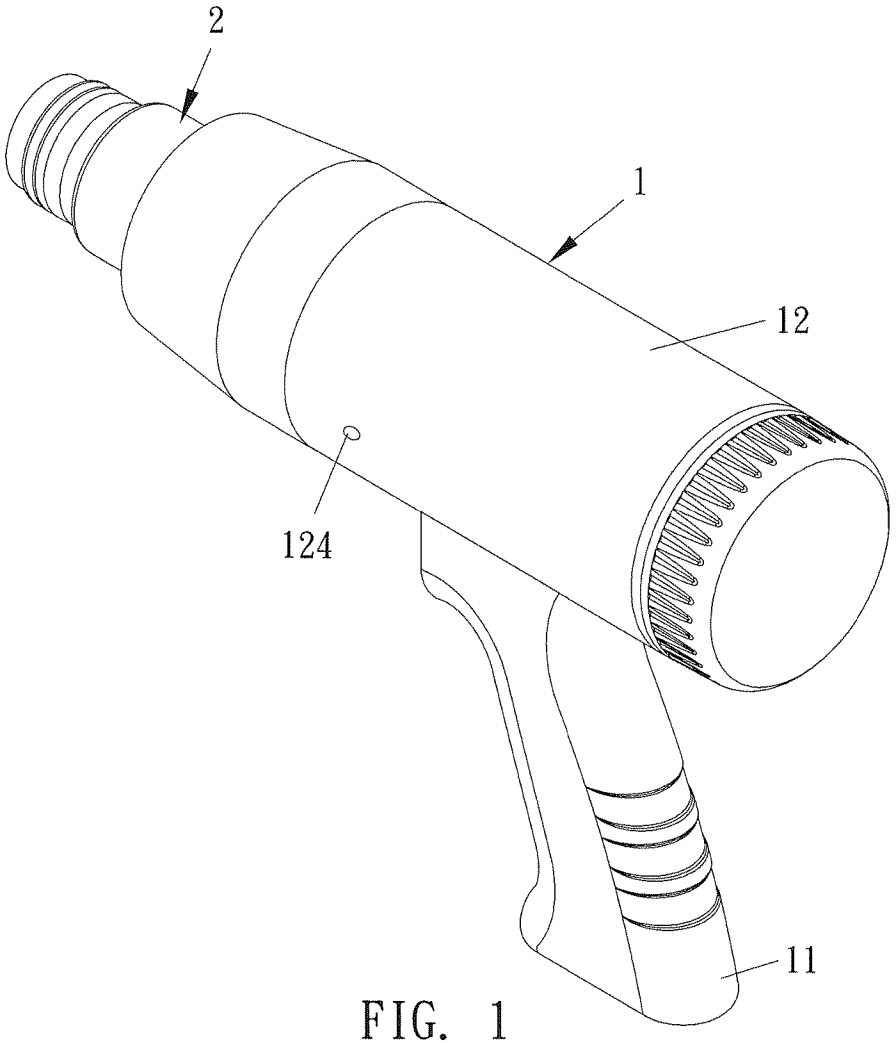
FIG. 1 is a perspective view showing the assembly of a pneumatic tool according to a preferred embodiment of the present invention.
Figure 2:
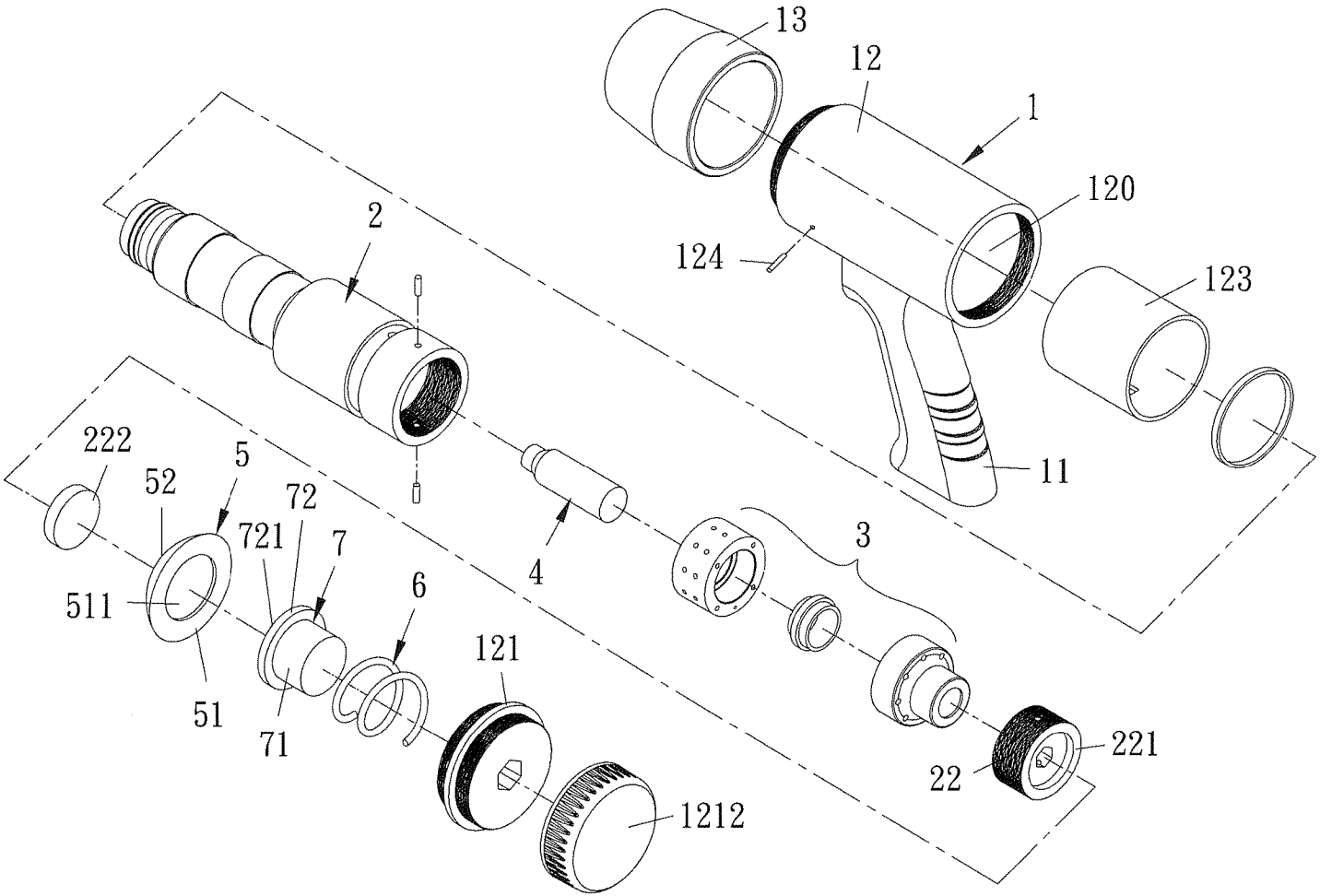
FIG. 2 is a perspective view showing the exploded components of the pneumatic tool according to the preferred embodiment of the present invention.
Figure 3:
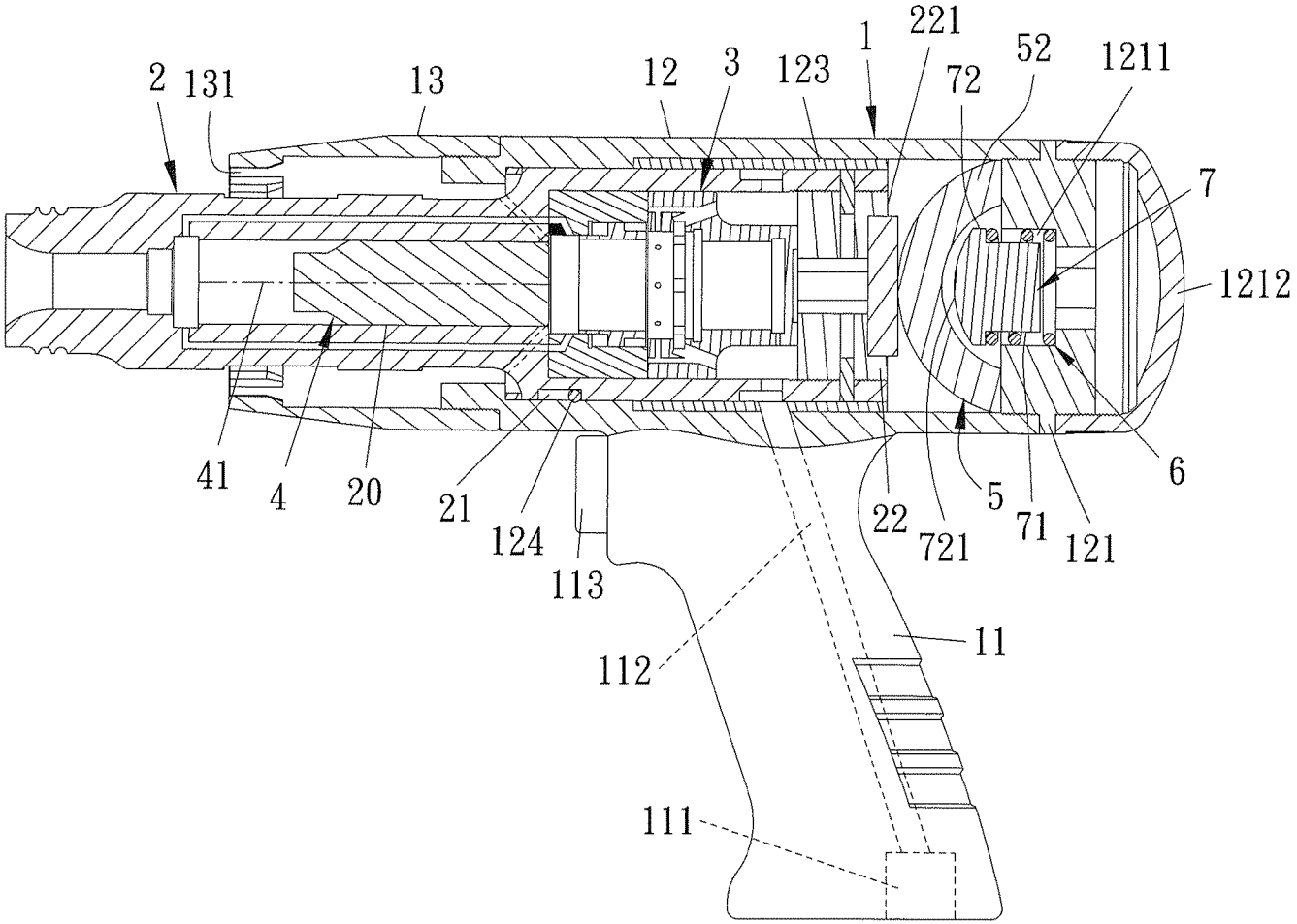
FIG. 3 is a cross sectional view showing the assembly of the pneumatic tool according to the preferred embodiment of the present invention.

With reference to FIGS. 1 to 3, a cushion device for a cylinder of a pneumatic tool according to a preferred embodiment of the present invention, wherein the pneumatic tool comprises: a body 1, a cylinder 2, a valve unit 3, a piston member 4, a cushion washer 5, at least one spring 6, and a limitation element 7, wherein the body 1 includes a grip 11 and a fitting sleeve 12 fitted with the grip 11, the grip 11 has an air inlet segment 111, an air passage 112 communicating with the air inlet segment 111, and a control switch 113 for controlling air to flow into the air inlet segment 111; the fitting sleeve 12 has a chamber 120 defined therein, a closing element 121 formed on a first end thereof, and an opening 122 formed on a second end thereof, wherein the closing element 121 has an accommodation trough 1211 defined on a first side thereof facing the opening 122 and has a lid 1212 formed on a second end thereof away from the opening 122, and the fitting sleeve 12 further has a bushing 123 fitted on an inner wall of the chamber 120 of the fitting sleeve 12, the fitting sleeve 12 further has an air exhaust cover 13 arranged on the second end thereof on which the opening 122 is formed, wherein the air exhaust cover 13 has multiple spaced air vents 131 arranged on an inner rim of one end thereof away from the fitting sleeve 12. The cylinder 2 is slidably fitted in the chamber 120 of the fitting sleeve 12, and a part of the cylinder 2 extends out of the fitting sleeve 12 from the opening 122 of the chamber 120. The cylinder 2 includes a room 20 formed therein, a defining slot 21 defined on an outer side thereof to insert a defining element 124 of the fitting sleeve 12, and an abutting portion 22 adjacent to the closing element 121 of the chamber 120 of the fitting sleeve 12, wherein the abutting portion 22 has a pressing face 221 relative to the closing element 121 of the chamber 120 of the fitting sleeve 12, and the pressing face 221 has a protective pad 222 fixed on a central position thereof. The valve unit 3 is mounted between the room 20 and the abutting portion 22 of the cylinder 2, such that high pressure air flows toward the valve unit 3 via the air passage 112 of the grip 11. The piston member 4 is accommodated in the room 20 of the cylinder 2 and slides forward and backward along a movement axis 41. The cushion washer 5 is flexible and is mounted in the chamber 120 of the fitting sleeve 12, and the cushion washer 5 abuts against the closing element 121 of the chamber 120 of the fitting sleeve 12 and the pressing face 221 of the abutting portion 22 of the cylinder 2. The cushion washer 5 includes an open segment 51 arranged on a first end thereof and corresponding to the closing element 121, the open segment 51 has at least one air groove 511 with a mouth parallel to the movement axis 41 of the piston member 4, and the open segment 51 contacts with the closing element 121, such that the at least one air groove 511 forms a flexible press space. The cushion washer 5 also includes a raised close segment 52 formed on a second end thereof and corresponding to the pressing face 221, the close segment 52 contacts with the protective pad 222 of the pressing face 221 or the pressing face 221. In this embodiment, the at least one spring 6 is a spring 6 which is fixed in the chamber 120 of the fitting sleeve 12 and is housed in the accommodation trough 1211 of the closing element 121, wherein the spring 6 is pressed by the cushion washer 5 to distort. The limitation element 7 is accommodated in the chamber 120 of the fitting sleeve 12 and includes a coupling portion 71 and a biasing portion 72, wherein the coupling portion 71 is fitted on the spring 6 so that the limitation element 7 is pushed by the spring 6 to move toward the cylinder 2. The biasing portion 72 extends out of the accommodation trough 1211, and the biasing portion 72 moves toward a bottom of the accommodation trough 1211 so as to press the spring 6. The biasing portion 72 has an arcuate resistance face 721 formed on one end thereof facing the cylinder 2.

Figure 4:
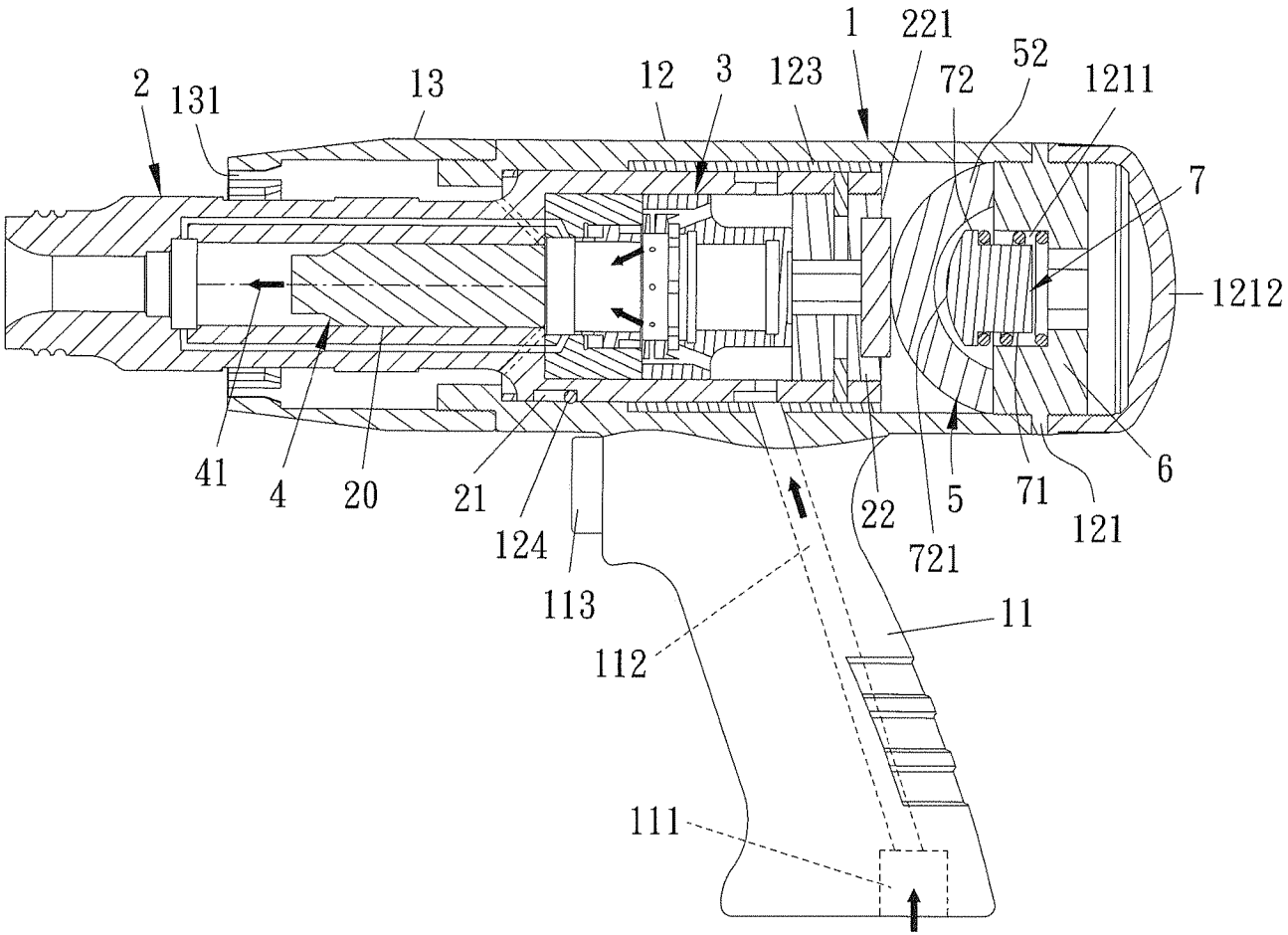
FIG. 4 is a cross sectional view showing the operation of a piston member of the pneumatic tool according to the preferred embodiment of the present invention.
Figure 5:
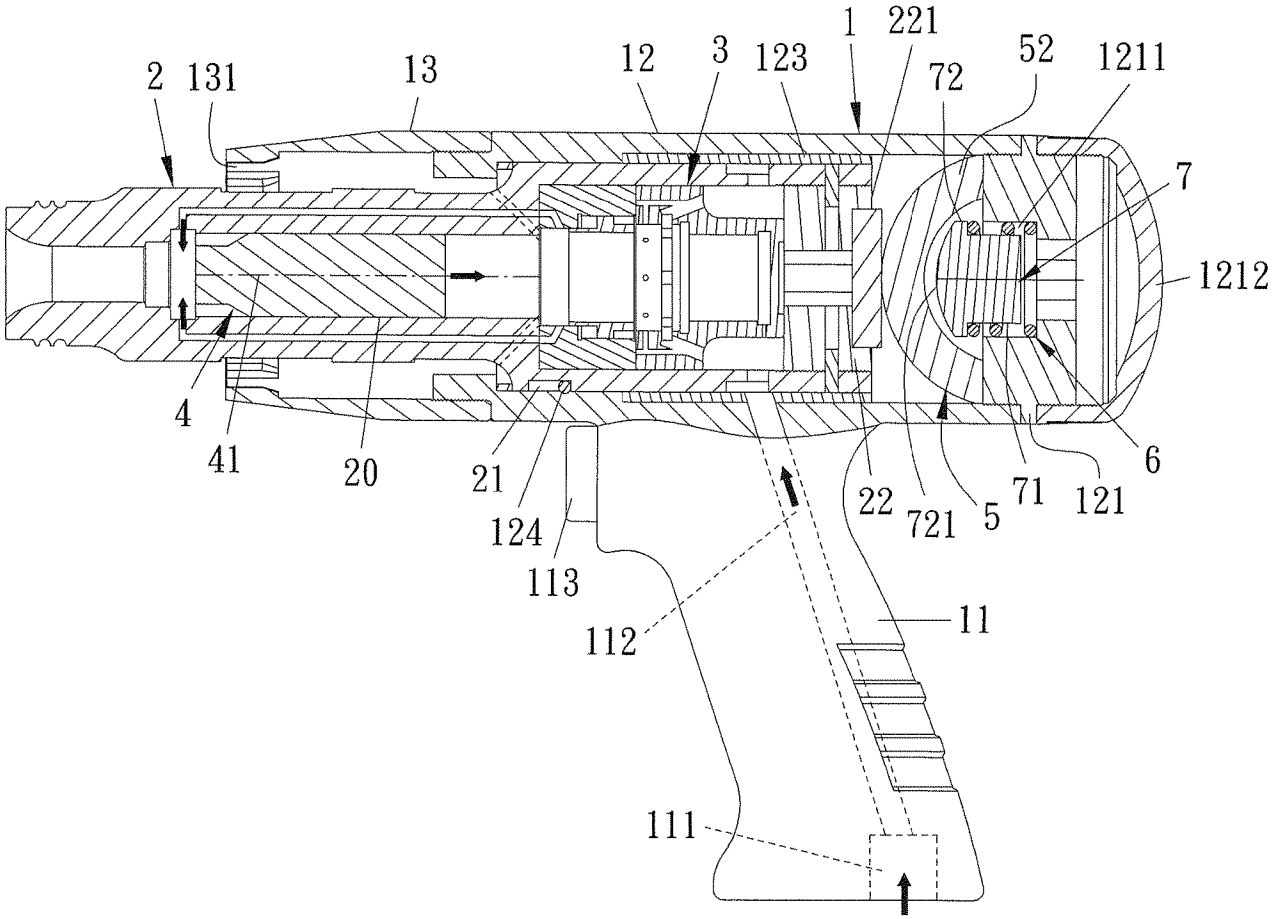
FIG. 5 is another cross sectional view showing the operation of the piston member of the pneumatic tool according to the preferred embodiment of the present invention.
Figure 6:
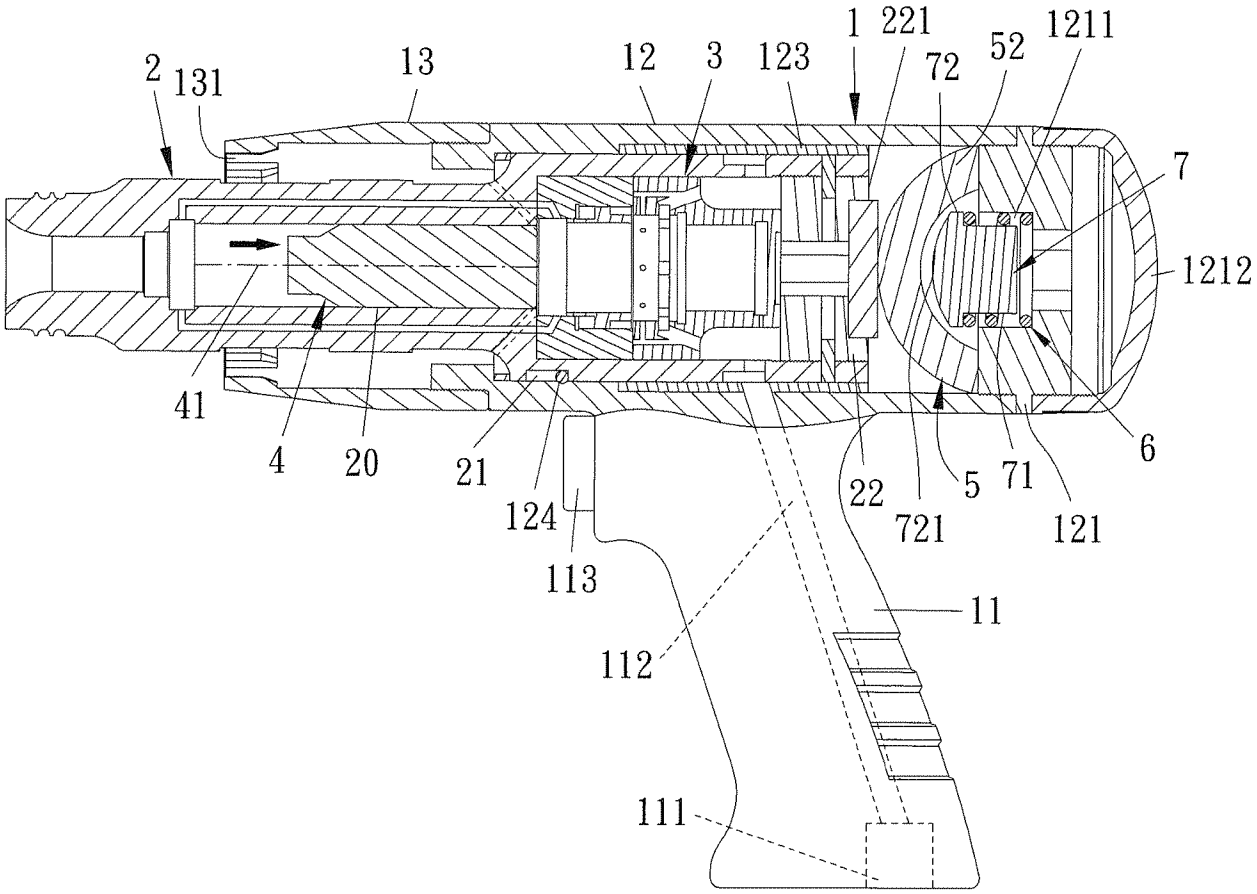
FIG. 6 is also another cross sectional view showing the operation of the piston member of the pneumatic tool according to the preferred embodiment of the present invention.

Referring to FIG. 4, after the control switch 113 on the grip 11 is turned on, the high pressure flows into a rear end of the room 20 of the cylinder 2 via the air passage 112 of the grip 11 and the valve unit 3 to push the piston member 4, and the piston member 4 moves toward a front end of the room 20 to impact a tool head (not shown) and is stopped by the tool head. As shown in FIGS. 5 and 6, the high pressure air is controlled by the valve unit 3 to flow into the front end of the room 20 of the cylinder 2 to push the piston member 4, hence the piston member 4 moves backward toward the rear end of the room 20 to impact the valve unit 3, and the valve unit 3 drives the cylinder 2 to move backward, such that the cushion washer 5 and the at least one air groove 511 produce compression like airbag. The limitation element 7 and the spring 6 are pressed by the cushion washer 5 which moves toward the bottom of the accommodation trough 1211 so that the spring 6 distorts, and the coupling portion 71 of the limitation element 7 abuts against the bottom of the accommodation trough 1211 so as to limit a pressing range of the spring 6. When the coupling portion 71 of the limitation element 7 abuts against the bottom of the accommodation trough 1211, the biasing portion 72 of the limitation element 7 extends out of the accommodation trough 1211, and the cushion washer 5 mates with the spring 6 to provide flexible deformation and to produce two-section compression like airbag with the at least one air groove 511 so as to absorb vibration doubly and to reduce reaction force which passes toward user's hand, thus pushing the piston member 4 forward and backward.

Figure 7:
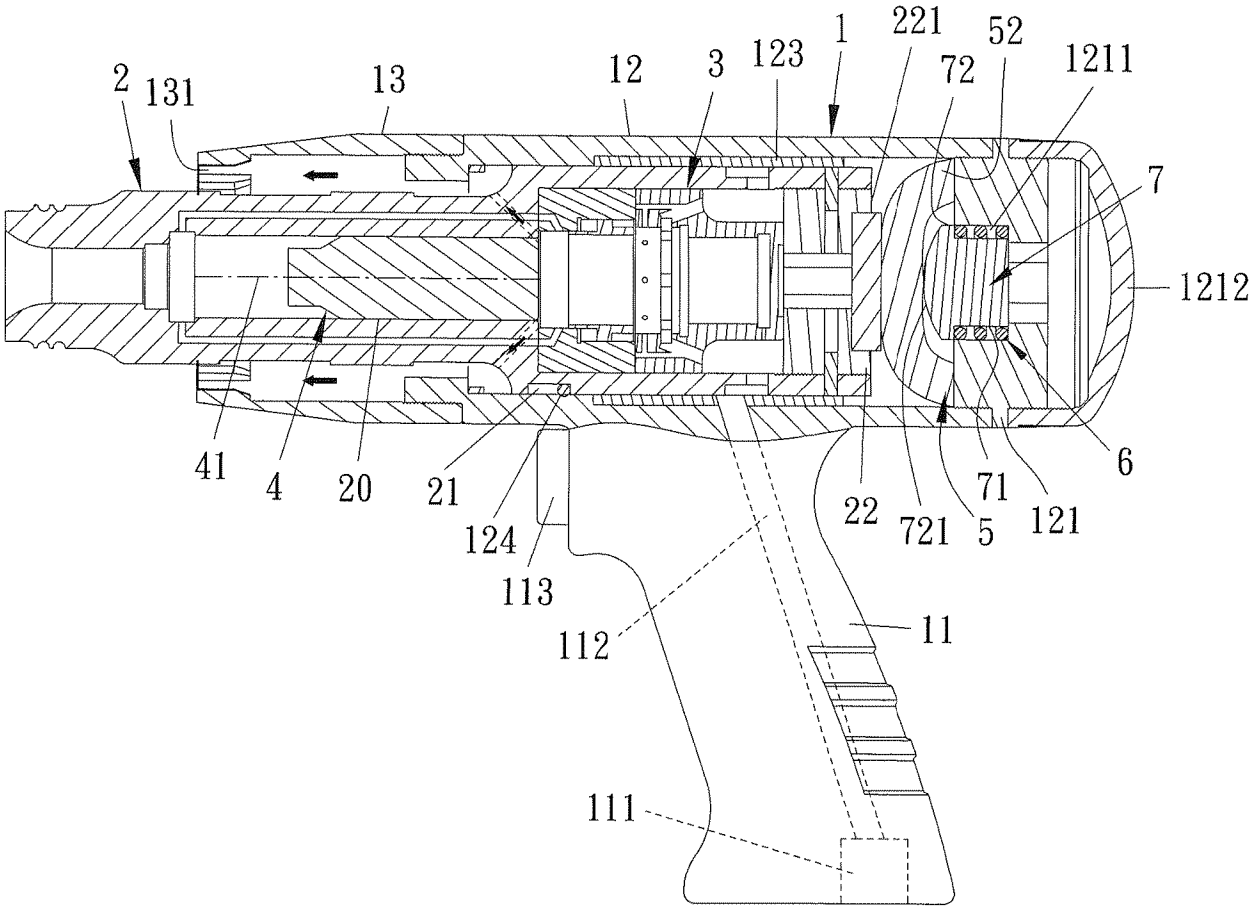
FIG. 7 is a cross sectional view showing the operation of a pneumatic tool according to the preferred embodiment of the present invention.

Furthermore, the fitting sleeve 12 of the body 1 further has an air exhaust cover 13 arranged on the second end thereof on which the opening 122 is formed, wherein the air exhaust cover 13 has multiple spaced air vents 131 arranged on an inner rim of one end thereof away from the fitting sleeve 12. Thereby, as shown in FIG. 7, the air exhausts from the multiple spaced air vents 131 of the air exhaust cover 13 so that the pneumatic tool operates smoothly.

Figure 8:
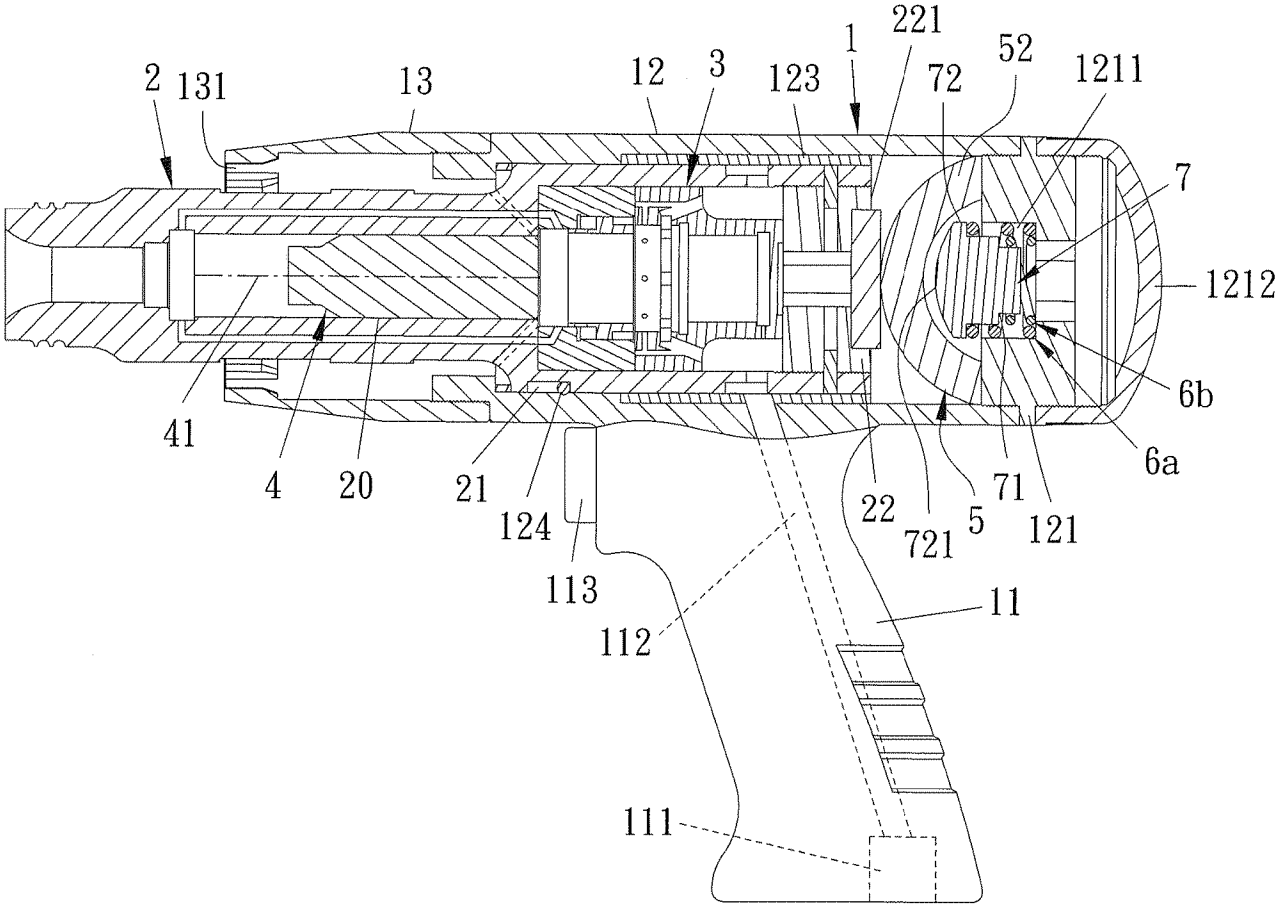
FIG. 8 is a cross sectional view showing the assembly of a pneumatic tool according to another preferred embodiment of the present invention.
Figure 9:
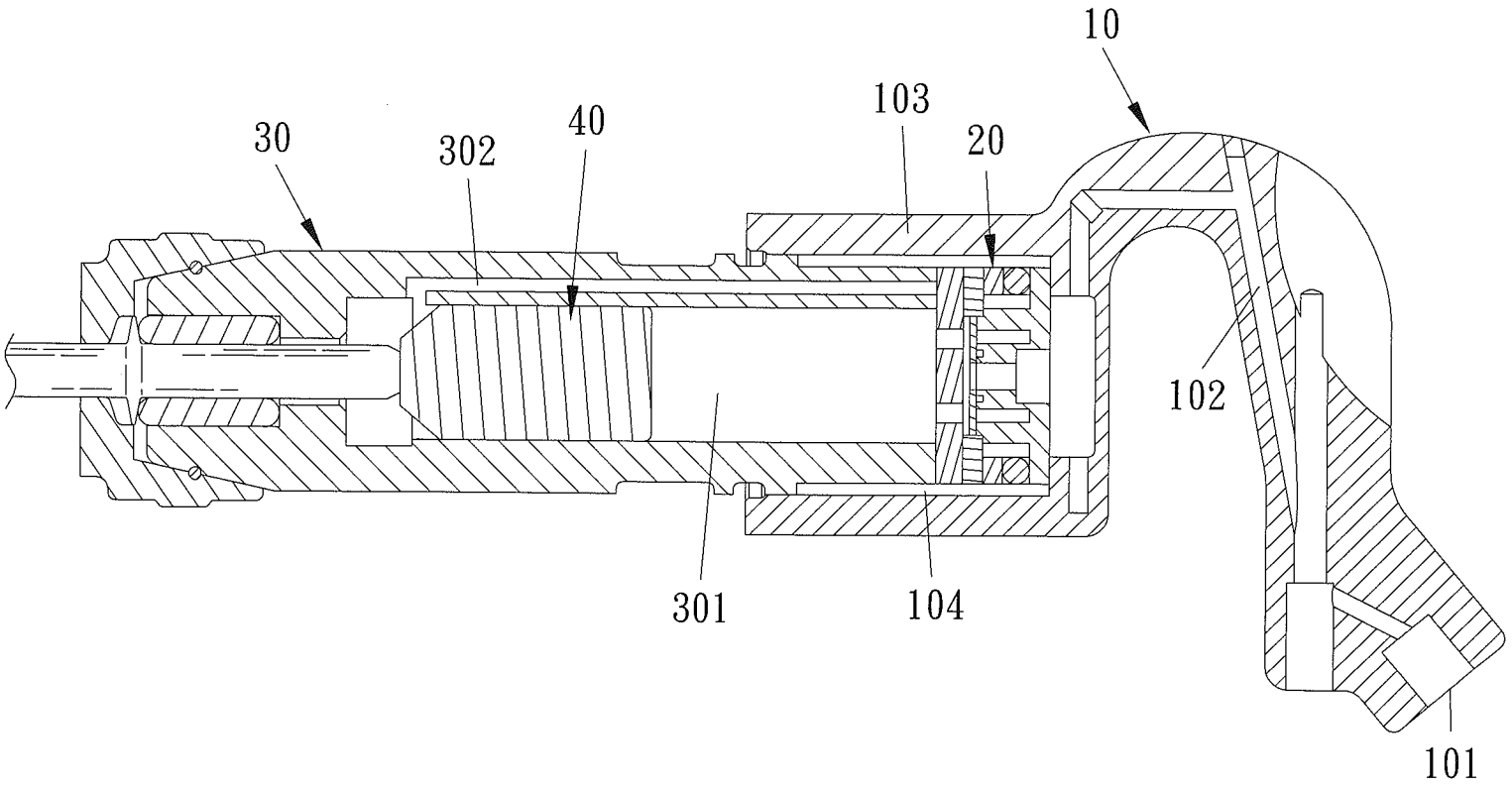
FIG. 9 Prior Art
FIG. 9 is a cross sectional view of a conventional pneumatic tool.

Referring to FIG. 8, the at least one spring 6 is two springs 6*a*, 6*b* which are fixed in the chamber 120 of the fitting sleeve 12 and are housed in the accommodation trough 1211 of the closing element 121, hence when the limitation element 7 and the two springs 6*a*, 6*b* are pressed by the cushion washer 5 which moves toward the bottom of the accommodation trough 1211, the two springs 6*a*, 6*b* are pressed to distort simultaneously or in turn.

Thereby, the cushion device of the present invention has advantages as follows:

1. The cushion washer 5 and the at least one spring 6 are mounted in the chamber 120 of the fitting sleeve 12 of the body 1, and the cushion washer 5 abuts against the closing element 121 of the chamber 120 of the fitting sleeve 12 and the pressing face 221 of the abutting portion 22 of the cylinder 2, wherein the cushion washer 5 includes at least one open segment 51 arranged on at least one end thereof, the open segment 51 has the at least one air groove 511, the at least one spring 6 is pressed by the cushion washer 5 to distort, and the at least one open segment 51 contacts with the closing element 121, such that when the piston member 4 moves backward to impact the valve unit 3, the cushion washer 5 mates with the at least one spring 6 to provide flexible deformation, and the cushion washer 5 and the at least one air groove 511 produce the two-section compression like the airbag to absorb the vibration doubly and to reduce the reaction force of the cylinder 2 which passes toward the user's hand, thus protecting the user's wrist.

2. The cushion washer 5 includes the at least one open segment 51 arranged on the at least one end thereof, and the open segment 51 has the at least one air groove 511, hence the cushion washer 5 mates with the at least one spring 6 and does not cause elastic fatigue in repeated use, thus reducing use cost.

While various embodiments in accordance with the present invention have been shown and described, it is clear to those skilled in the art that further embodiments may be made without departing from the scope of the present invention.

What is claimed is:

1. A cushion device for a cylinder of a pneumatic tool, and the pneumatic tool comprising:

a body including a grip and a fitting sleeve fitted with the grip, the fitting sleeve having a chamber defined therein, a closing element formed on a first end thereof, and an opening formed on a second end thereof, the closing element having an accommodation trough defined on a first side thereof facing the opening;

a cylinder slidably fitted in the chamber of the fitting sleeve, and a part of the cylinder extending out of the fitting sleeve from the opening of the chamber, the cylinder including a room formed therein and an abutting portion adjacent to the closing element of the chamber of the fitting sleeve;

a valve unit mounted between the room and the abutting portion of the cylinder;

a piston member accommodated in the room of the cylinder and sliding forward and backward along a movement axis;

a cushion washer being flexible and mounted in the chamber of the fitting sleeve, and the cushion washer abutting against the closing element of the chamber of the fitting sleeve and the pressing face of the abutting portion of the cylinder, wherein the cushion washer includes at least one open segment arranged on at least one end thereof corresponding to the closing element, the at least one open segment has the at least one air groove, and each of the at least one air groove having a mouth parallel to the movement axis of the piston member, the cushion washer also includes a raised close segment formed on a second end thereof and corresponding to the pressing face; and at least one spring fixed in the chamber of the fitting sleeve and housed in the accommodation trough of the closing element, wherein the at least one spring is pressed by the cushion washer to distort.

2. The cushion device for the cylinder of the pneumatic tool as claimed in claim 1, the pneumatic tool further comprising a limitation element, wherein the limitation element is accommodated in the chamber of the fitting sleeve and includes a coupling portion and a biasing portion, wherein the coupling portion is fitted on the spring so that the limitation element is pushed by the spring to move toward the cylinder, and the biasing portion extends out of the accommodation trough and moves toward a bottom of the accommodation trough so as to press the spring.

3. The cushion device for the cylinder of the pneumatic tool as claimed in claim 2, wherein the biasing portion of the limitation element has an arcuate resistance face formed on one end thereof facing the cylinder.

4. The cushion device for the cylinder of the pneumatic tool as claimed in claim 2, wherein when the coupling portion of the limitation element abuts against the bottom of the accommodation trough, the biasing portion of the limitation element extends out of the accommodation trough.

5. The cushion device for the cylinder of the pneumatic tool as claimed in claim 1, wherein the fitting sleeve of the body further has an air exhaust cover arranged on one end of the fitting sleeve on which the opening is formed, and the air exhaust cover has multiple spaced air vents arranged on an inner rim of one end thereof away from the fitting sleeve.

6. The cushion device for the cylinder of the pneumatic tool as claimed in claim 1, wherein the cylinder includes a receiving slot defined on an outer side thereof so as to accommodate a defining stem of the fitting sleeve.

7. The cushion device for the cylinder of the pneumatic tool as claimed in claim 1, wherein the pressing face of the abutting portion of the cylinder has a protective pad fixed on a central position thereof.

8. The cushion device for the cylinder of the pneumatic tool as claimed in claim 1, wherein the at least one spring is two springs which are fixed in the chamber of the fitting sleeve and are housed in the accommodation trough of the closing element, hence when the limitation element and the two springs are pressed by the cushion washer which moves toward a bottom of the accommodation trough, the two springs are pressed to distort simultaneously or in sequence.

* * * * *